US005864731A

United States Patent [19]

Ikemoto et al.

[11] Patent Number: 5,864,731

[45] Date of Patent: Jan. 26, 1999

[54] PROCESS CARTRIDGE, DEVELOPMENT APPARATUS, AND ELECTROPHOTOGRAPHIC IMAGE FORMATION APPARATUS WITH PLURAL TONER FEEDING MEMBERS

[75] Inventors: Isao Ikemoto, Kashiwa; Shinichi Sasaki, Fujisawa, both of Japan

[73] Assignee: Canon Kabushiki Kaisa, Tokyo, Japan

[21] Appl. No.: 780,757

[22] Filed: Jan. 8, 1997

[30] Foreign Application Priority Data

Jan. 9, 1996 [JP] Japan ..... 8-018088
Dec. 17, 1996 [JP] Japan ..... 8-353486

[51] Int. Cl.[6] ..... G03G 15/08

[52] U.S. Cl. ..... 399/27; 399/53; 399/111

[58] Field of Search ..... 399/27, 28, 30, 399/53, 252, 258, 111

[56] References Cited

U.S. PATENT DOCUMENTS

| | | | |
|---|---|---|---|
| 4,920,381 | 4/1990 | Mahoney | 399/258 |
| 5,126,800 | 6/1992 | Shishido et al. | 355/211 |
| 5,134,441 | 7/1992 | Nagata et al. | 355/245 |
| 5,198,860 | 3/1993 | Yamanaka et al. | 355/246 |
| 5,331,372 | 7/1994 | Tsuda et al. | 355/200 |
| 5,404,198 | 4/1995 | Noda et al. | 355/200 |
| 5,436,700 | 7/1995 | Kikuchi et al. | 355/215 |
| 5,463,446 | 10/1995 | Watanabe et al. | 355/200 |
| 5,470,635 | 11/1995 | Shirai et al. | 428/131 |
| 5,475,470 | 12/1995 | Sasago et al. | 355/210 |
| 5,485,249 | 1/1996 | Higeta et al. | 355/210 |
| 5,488,459 | 1/1996 | Tsuda et al. | 355/211 |
| 5,510,878 | 4/1996 | Noda et al. | 355/211 |
| 5,543,898 | 8/1996 | Shishido et al. | 355/210 |
| 5,550,617 | 8/1996 | Odagawa et al. | 355/210 |
| 5,581,325 | 12/1996 | Tsuda et al. | 355/200 |
| 5,583,613 | 12/1996 | Kobayashi et al. | 355/200 |
| 5,585,902 | 12/1996 | Nishiuwatoko et al. | 355/260 |
| 5,602,623 | 2/1997 | Nishibata et al. | 399/111 |
| 5,608,509 | 3/1997 | Shirai et al. | 399/351 |
| 5,623,328 | 4/1997 | Tsuda et al. | 399/111 |

FOREIGN PATENT DOCUMENTS

| | | |
|---|---|---|
| 0117088 | 8/1984 | European Pat. Off. . |
| 0514874 | 11/1992 | European Pat. Off. . |
| 0586042 | 3/1994 | European Pat. Off. . |
| 1-84266 | 3/1989 | Japan . |
| 2-39177 | 2/1990 | Japan . |

*Primary Examiner*—Joan H. Pendegrass
*Attorney, Agent, or Firm*—Fitzpatrick, Cella, Harper & Scinto

[57] ABSTRACT

A process cartridge detachably mountable relative to a main assembly of an electrophotographic image forming apparatus, includes an electrophotographic photosensitive member; a developing device for developing a latent image formed on the electrophotographic photosensitive member; a toner accommodating portion for accommodating toner to be used by the developing device to develop the latent image; a first toner feeding member for feeding the toner accommodated in the toner accommodating portion toward the developing device; a second toner feeding member for feeding the toner accommodated in the toner accommodating portion toward the developing device; wherein the second toner feeding member starts to operate in response to detection of decrease of a remaining amount of the toner accommodated in the toner accommodating portion to feed the toner accommodated in the toner accommodating portion toward the developing device.

34 Claims, 10 Drawing Sheets

PROCESS CARTRIDGE, DEVELOPMENT APPARATUS, AND ELECTROPHOTOGRAPHIC IMAGE FORMATION APPARATUS WITH PLURAL TONER FEEDING MEMBERS

FIELD OF THE INVENTION AND RELATED ART

The present invention relates to a process cartridge, a development apparatus, and an electrophotographic image formation apparatus.

In this specification, an electrophotographic image formation apparatus means an apparatus such as an electrophotographic copy machine, an electrophotographic printer (LED printer, laser beam printer, and the like), an electrophotographic facsimile apparatus, an electrophotographic word processor, and the like, which employ an electrophotographic image formation process to form an image on recording medium.

A process cartridge means a cartridge which is removably mountable in the main assembly of an image forming apparatus, and in which a charging means, a developing means, and/or a cleaning means, and an electrophotographic photosensitive member, are integrally disposed, a cartridge which is removably mountable in the mains assembly of an image forming apparatus, and in which at least one processing means among a charging means, a developing means, and a cleaning means is integrally disposed with an electrophotographic photosensitive drum, and a cartridge which is removably mountable in the main assembly of an image forming apparatus, and in which at least a developing means, and an electrophotographic photosensitive member, are integrally disposed.

A conventional image formation apparatus employing an electrophotographic image formation process employs a process cartridge system in which an electrophotographic photosensitive member, and processing means which act on the electrophotographic photosensitive member, are integrally disposed in a cartridge which is removably mountable in the main assembly of an image forming apparatus.

According to this process cartridge system, an image forming apparatus can be maintained without relying on service personnel; an image forming apparatus can be maintained by a user alone. Therefore, operational efficiency can be greatly improved. Thus, the process cartridge system is widely employed in the field of an image formation apparatus.

Some of image forming apparatuses are provided with a means for detecting the amount of remaining developer. This detecting means issues a warning to a user before the amount of developer in the developer containing portion decreases to a critical point below which the apparatuses begin outputting a blurred image, that is, a low density image.

The present invention was made as a result of further development of the above described conventional art.

SUMMARY OF THE INVENTION

Accordingly, the primary object of the present invention is to provide a process cartridge, a development apparatus, and an electrophotographic image formation apparatus, which are capable of effectively the dealing with the decrease in the toner supply in the toner containing portion before it reaches a critical point.

Another object of the present invention is to provide a process cartridge, a development apparatus, and an electrophotographic image formation apparatus, which comprise a means which begins to feed developer toward a development station as the amount of the toner in the toner containing portion decreases to a predetermined level.

Another object of the present invention is to provide a process cartridge, a development apparatus, and an electrophotographic image formation apparatus, which are capable of consuming the toner contained in the toner containing portion, with high utilization efficiency.

According to an aspect of the present invention, there is provided a process cartridge detachably mountable relative to a main assembly of an electrophotographic image forming apparatus, comprising an electrophotographic photosensitive member; developing means for developing a latent image formed on said electrophotographic photosensitive member; a toner accommodating portion for accommodating toner to be used by said developing means to develop the latent image; a first toner feeding member for feeding the toner accommodated in said toner accommodating portion toward said developing means; a second toner feeding member for feeding the toner accommodated in the toner accommodating portion toward said developing means; wherein said second toner feeding member starts to operate in response to detection of decrease of a remaining amount of the toner accommodated in the toner accommodating portion to feed the toner accommodated in the toner accommodating portion toward said developing means.

According to an aspect of the present invention, a process cartridge, a development apparatus, and an electrophotographic image formation apparatus comprise: a development member for developing a latent image formed on an electrophotographic photosensitive member; a toner storing portion for storing the toner to be used by the development member to develop the latent image; a first toner conveyance member for conveying the toner held in the toner storing portion toward the development member; and a second toner conveyance member for conveying the toner held in the toner storing portion toward the development member, wherein the second toner conveyance member starts conveying the toner held in the toner storing portion toward the developing means in response to detection of decrease in the remaining toner in the toner storing portion to a predetermined level.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, electrophotographic image formation apparatuses, process cartridges, and development apparatuses, which are in accordance with the present invention, will be described in detail with reference to the drawings.

Embodiment 1

First, referring to FIGS. 1–8, the process cartridge in this embodiment, and an electrophotographic image formation apparatus compatible with such a process cartridge, will be described in detail.

Figure 1:
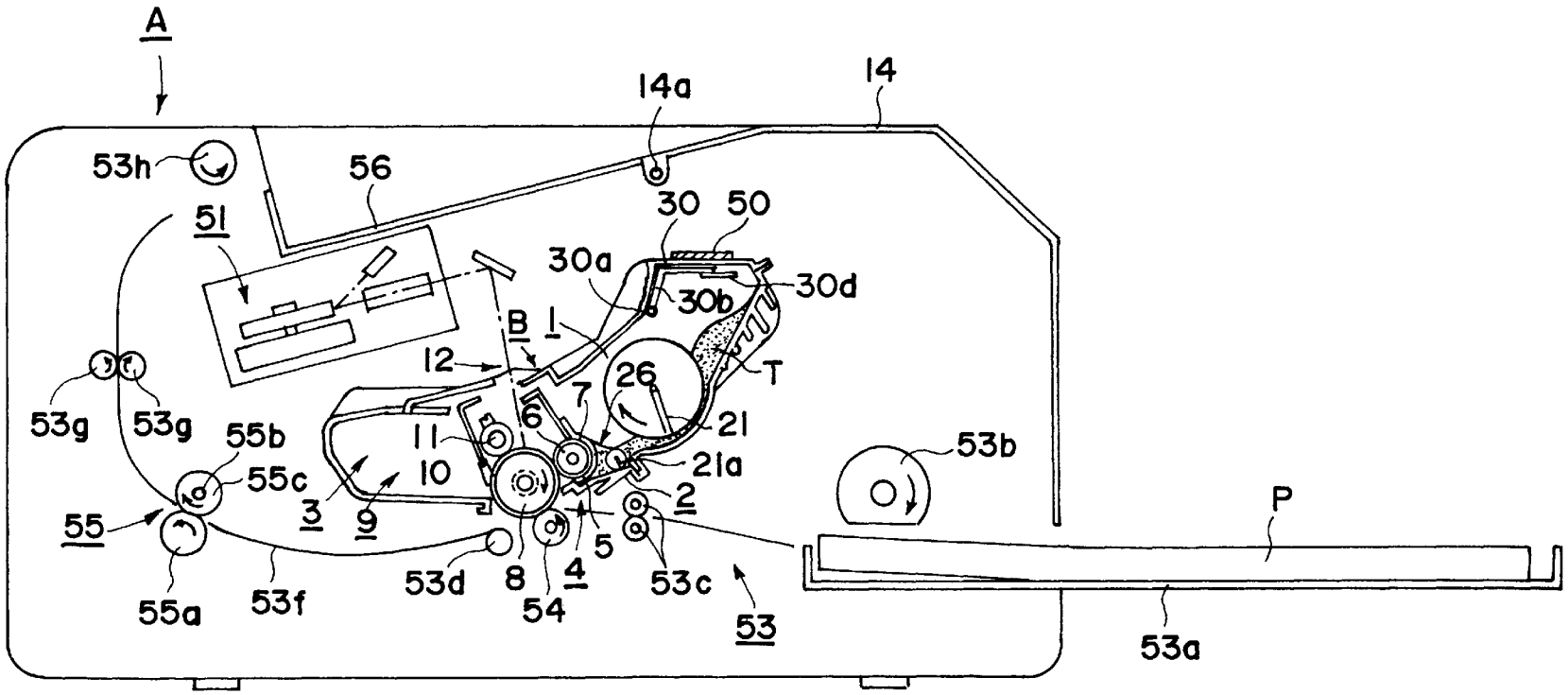
FIG. 1 is a schematic sectional view of an embodiment of the image formation apparatus in accordance with the present invention, and depicts the general structure thereof.

Referring to FIG. 1, in image formation apparatus A (laser beam printer), a laser beam which is carrying image data is projected from an optical system 51 onto an electrophotographic photosensitive member 8 (hereinafter, photosensitive drum) in the form of a drum, and forms a latent image on the photosensitive layer thereof, and this latent image is developed into a toner image.

In synchronism with the formation of the toner image, a recording medium P is fed out of a sheet feeder cassette 5, and is conveyed into the image forming station of a process cartridge B, by a conveying means comprising a pickup roller 53*b*, a conveyer roller pair 53*c*, conveyer roller 53*d*, and the like. In the image forming station, the toner image formed on the photosensitive drum 8 is transferred onto the recording medium P by applying voltage to a transfer roller 54 as a transferring means. Then, the recording medium P is conveyed, being guided by a guide plate 53*f*, to a fixing means 55.

The fixing means 55 comprises a driver roller 55*a*, and a fixer roller 55*c* containing a heater 55*b*, and fixes the transferred toner image to the recording medium P by applying heat and pressure, as the recording medium P passes through the fixing means 55. Thereafter, the recording medium P is further conveyed through a reversing path, and is discharged into a delivery tray 56, by a discharge roller pair 53*g* and a discharge roller 53*h*.

The process cartridge B comprises an electrophotographic photosensitive member, and at least one processing means. The processing means includes a charging means for charging the electrophotographic photosensitive member, a developing means for developing a latent image formed on the electrophotographic photosensitive member, a cleaning means for cleaning the toner remaining on the surface of the electrophotographic photosensitive member, and the like means.

Figure 2:
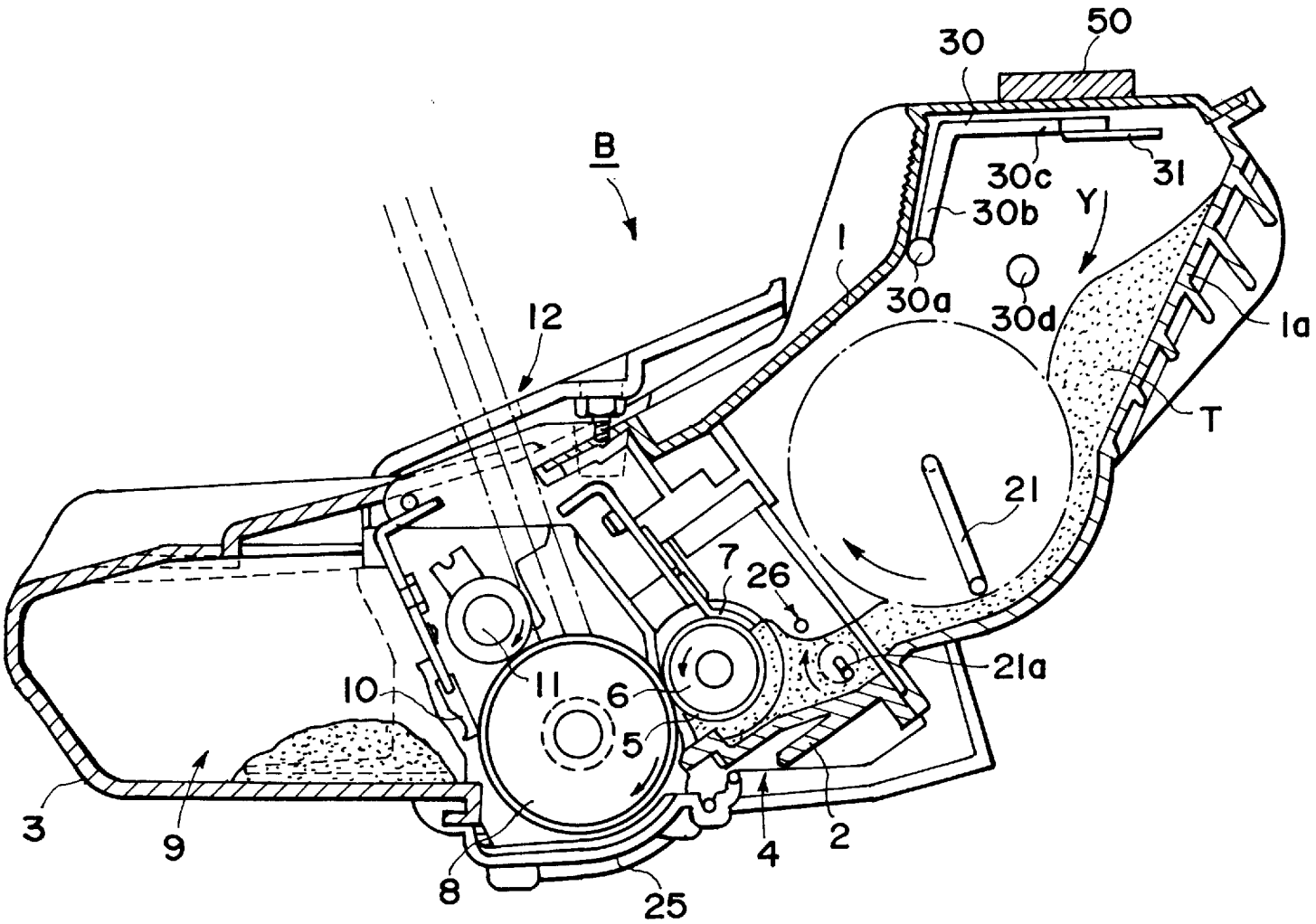
FIG. 2 is a sectional view of the process cartridge in the first embodiment.

Referring to FIG. 2, in the process cartridge B in this embodiment, a charger 11, an exposure opening 12 for allowing the laser beam to be projected onto the photosensitive drum 8, a developing means 4 for developing a latent image with the use of toner, and a cleaning means 9, are disposed around the electrophotographic photosensitive drum 8. These components are integrally disposed in a toner containing frame portion 1 as a developer containing portion, a development frame portion 2, or a cleaning frame portion 3. In other words, the process cartridge B is constructed by uniting the toner containing frame portion 1, the development frame portion 2 which supports the development roller 5 or the like, and the cleaning frame portion 3 which supports the photosensitive drum 8, the cleaning means 9, and the charger 11.

The developing means 4, which uses magnetic toner as developer to form a toner image, comprises a toner storing portion 1 for holding toner. The toner storing portion 1 is provided with a toner feeding member 21, which is rotated in the direction of an arrow mark to feed the toner toward the development roller 5 as a developer carrier, while preventing the coagulation and local concentration of the toner. The development roller 5 contains a magnet 6 which attracts the toner supplied to the development roller 5 and holds it on the surface of the development roller 5. Further, an elastic blade 7 is placed in contact with the surface of the development roller 5 to form a thin layer of toner on the surface of the development roller 5 by regulating the thickness of the toner layer formed on the surface of the development roller 5. While the toner layer is formed on the development roller 5 as the development roller 5 is rotated, the toner becomes charged due to the friction between the toner and the rotating development roller 5, and obtains a sufficient amount of triboelectric charge to develop the electrostatic image on the photosensitive drum 8.

In this embodiment, a voltage composed by superposing a DC component (approximately−500 V) upon an AC voltage component (Vpp is approx. 1600 V) is applied as a development bias to the development roller 5.

The development roller 5 on which the aforementioned toner layer is formed, and the photosensitive drum 8, are positioned adjacent to each other, holding a microscopic gap (approximately 250 $\mu$m). This positional arrangement is realized by fitting the development roller 5 with contact rings (unillustrated) having a diameter larger, by the aforementioned microscopic gap, than the diameter of the development roller 5. More specifically, the rings are fitted around the development roller 5, adjacent to the corresponding axial ends, outside the toner layer formation region, and make contact with the photosensitive drum 8, on the regions outside the latent image formation region.

Further, one of the axial ends of the development roller 5 is provided with a first helical gear (unillustrated) through which the development roller 5 receives a force which rotatively drive the development roller 5. The first helical gear is meshed with a second helical gear (unillustrated) fixed to the corresponding axial end of the photosensitive drum 8, so that the development roller 5 is rotated by the rotation of the photosensitive drum 8. Also, the first helical gear is meshed with a third helical gear (unillustrated) connected to the toner feeding member 21, so that the rotational force of the photosensitive drum 8 is also transmitted to the toner feeding member 21. It should be noted here that the second helical gear is the gear which meshes with a helical gear provided on the main assembly side of an image formation apparatus, to receive the driving force therefrom, and therefore, the toner feeding member 21 is also rotated by the rotation of the photosensitive drum 8. In other words, the toner feeding member 21 rotates as it receives the driving force from the main assembly of an image formation apparatus during image formation. A reference alphanumeric 21*a* designates an auxiliary toner feeding member, which rotates with the same timing as the toner feeding member 21.

Next, referring mainly to FIGS. 2 and 3, the developer conveying means, which characterizes the present invention, will be described.

The developer conveying means 30 is in the modified form of a crank and is disposed in the toner storing portion 1, outside the sweeping range of the toner feeding member 21. It comprises rotational axis portions 30*a* and 30*a* rotatively supported by the internal wall of the toner storing portion 1, arm portions 30*b* and 30*b* extending from the rotational axis portions 30*a* and 30*a*, a horizontal portion 30*c* connected to the arm portions 30*b* and 30*b*, and a flexible member 31 attached to the horizontal portion 30*c*. Referring to FIG. 2, the arm portion 30*b* is bent so that the developer conveying means 30 remains substantially in contact with the ceiling portion of the toner storing portion 1 when not operating. The flexible member 31 is formed of a sheet of polyethylene terephthalate or rubber, for example. The rotational axis portion 30*a*, the arm portion 30*b*, and the horizontal portion 30*c* are formed of nonmagnetic metallic material or plastic resin.

Figure 3:
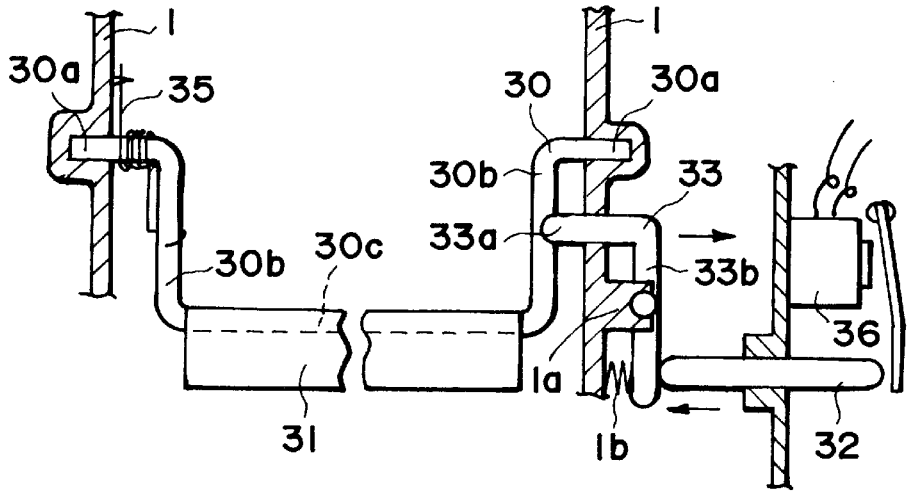
FIG. 3 is a schematic drawing of the developer conveying means of the process cartridge illustrated in FIG. 2.

Referring to FIG. 3, one of the rotational axis portions 30*a* and 30*a* is fitted with an operational spring 35 (torsional coil spring). One end of the operational spring 35 is attached to the wall of the toner storing portion 1, and the other end is attached to the arm portions 3*b*, to apply pressure to the developer conveying means 30 in the direction of the toner feeding member 21. The other rotational axis portion 30*a* is engaged with a claw portion 33*a* of a lever 33 which is put through the wall of the toner storing portion 1, to prevent the developer conveying means 30 from being rotated by the pressure from the operational spring 35, during the non-operational period of the developer conveying means.

The lever 33 of the process cartridge 33 is in the form of a letter L, and is rotatively supported by a supporting member 1*a* at the middle of the vertical portion 33*b* connected to the claw portion 33*a*. One end of the vertical portion 33*b*, that is, the end opposite to the claw portion 33*a*, is provided with a spring member 1*b* which applies pressure to the vertical portion 33*b* in a manner to rotate the vertical portion 33*b* about the supporting member 1*a* in the counterclockwise direction. This arrangement keeps the claw portion 33*a* in contact with the arm portion 30*b* of the developer conveying means 30.

The main assembly of the image formation apparatus is provided with a lever 32 and a solenoid 36. After the process cartridge is mounted in the apparatus main assembly, the lever 32 on the main assembly side is capable of pressing the vertical portion 33*b* of the lever 33 of the process cartridge B, on the surface opposite to the surface with which the spring member 1*b* is in contact. The solenoid 33 presses the lever 32 on the main assembly side.

As described above, the toner feeding member 21 and the developer conveying means 30 are disposed within the toner storing portion 1, and the development roller 5 and the elastic blade 7 are attached to the development frame portion 2. The photosensitive drum 8, a primary charger 11, and the cleaning blade 10 are disposed in the cleaning frame portion 3.

Further, the process cartridge B is provided with a drum shutter 25 which prevents the photosensitive drum 8 from being inadvertently exposed to light or damaged. This drum shutter 25 is automatically opened as the process cartridge B is mounted in the apparatus main assembly, and is automatically closed by the pressure from a spring (unillustrated) as the process cartridge B is removed from the apparatus main assembly.

The developer conveying means 30 is activated in response to the detection of the decrease in the amount of the toner held in the toner storing portion 1, and feeds the toner held in the toner storing portion 1 toward the development roller 5. This action of the developer feeding means 30 is caused by the resiliency of the elastic member such as a coil spring or a compression spring.

Further, the developing means 4 of this embodiment is provided with a toner remaining detecting means 26 for detecting the presence or absence of toner within the toner storing portion 1. Next, the structure of the remaining toner detecting means will be described.

Referring to FIG. 2, there is a metallic antenna wire 26 as an antenna member in the toner path through which toner is conveyed from the toner storing portion 1 to the development roller 5. It is fixed to the development frame portion 2 substantially in parallel to the metallic development roller 5. This antenna wire 26 and the development roller 5 are used as a first electrode and a second electrode, respectively, wherein voltage is applied between the two electrodes, and the presence or absence of the toner is detected by detecting the change in the electrostatic capacity between the two electrodes.

In other words, when there is a sufficient amount of toner in the toner storing portion 1, toner is present between the two electrodes, and therefore, the electrostatic capacity between the two electrodes is large, but when toner disappears from between the two electrodes as toner is consumed, the electrostatic capacity between the two electrodes decreases. This change in the electrostatic capacity is detected by the remaining toner detection circuit provided on the apparatus main assembly side, and when the detected electrostatic capacity is below a predetermined value, it is determined that toner is absent.

Figure 4:
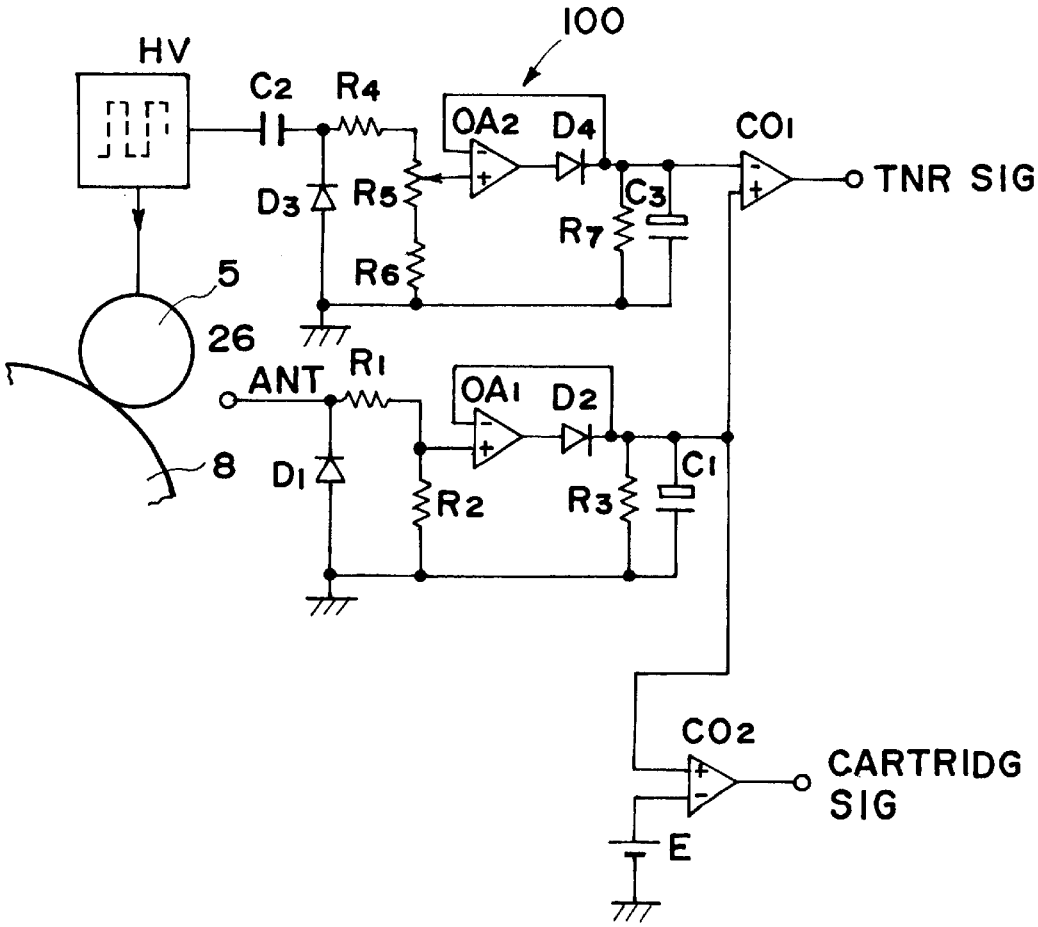
FIG. 4 is a circuit diagram for a remaining toner detection circuit in the image formation apparatus illustrated in FIG. 1.

FIG. 4 shows a remaining toner detection circuit 100 provided on the apparatus main assembly side. In this circuit 100, the circuit portion comprising the development roller 5 and the antenna wire 26 are equivalent to a condenser, wherein an AC voltage (Vpp is approx. 1600 V) having a rectangular waveform is applied to the development roller 5 from a high voltage power source HV provided in the apparatus main assembly.

In reality, the waveform of the high voltage from the high voltage power source HV involves an inclination in its rising and falling portions, and is detected as a differential waveform ANT by the electrostatic capacity between the development roller 5 and the antenna wire 26, and resistors R1 and R2. A diode D1 is a clamping diode whose output is negative.

The differential waveform ANT is divided by the resistances R1 and R2, and its peak is detected by a first peak hold circuit comprising an operational amplifier OA1, a diode D2, and a condenser C1, and is converted to a DC signal. A resistor R3 is provided for discharging the condenser C1.

The electrostatic capacity between the development roller 5 and the antenna wire 26 is dependent on the amount of toner present between the development roller 5 and the antenna wire 26. That is, as the amount of the toner between two electrical conductors increases, the dielectric constant between the two conductors increases, which in turn increases the electrostatic capacity between the two conductors. Conversely, the dielectric constant between the two conductors decreases as the amount of the toner between the two conductors decreases, reducing thereby the electrostatic capacity between the two. Therefore, the voltage detected by the first peak hold circuit decreases as the amount of the toner decreases.

On the other hand, the output from the high voltage power source HV is supplied to the development roller 5, and also to a differentiation circuit comprising a reference condenser C2, resistors R4, R5 (volume resistor), and R6. A diode D3 is a clamping diode whose output is negative.

The differential waveform detected through the volume resistor R5 is converted into a DC signal by a second peak hold circuit comprising an operational amplifier OA2, a diode D4, the condenser C3, and a discharge resistor R7. The volume resistor R5 is adjusted so that the output from the second peak hold circuit matches a predetermined reference value (approximately 2.7 V in this embodiment).

The output from the first peak hold circuit (potential of condenser C1 value proportional to the amount of the remaining toner), and the output from the second peak hold circuit (potential of condenser C3 reference value), are compared by a comparator CO1, and is outputted as a signal indicating the amount of the remaining toner. When there is a sufficient amount of toner between the development roller 5 and the antenna wire 26, the output of condenser C1 remains at a low level. Therefore, the amount of the remaining toner can be detected from the output of the comparator CO1.

Figure 5:
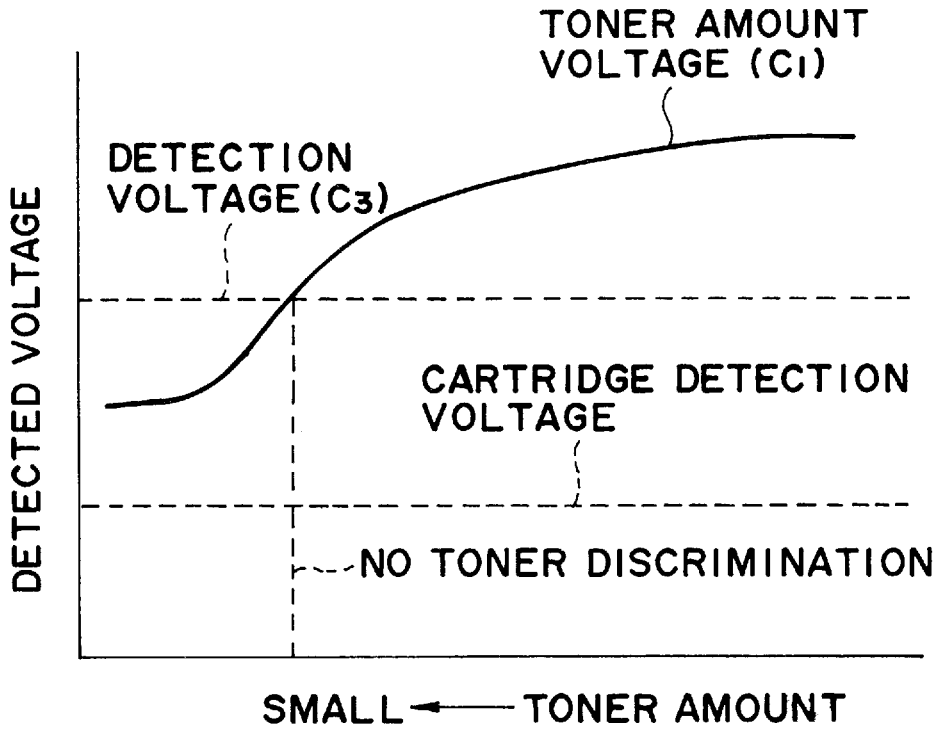
FIG. 5 is a graph showing the discrimination reference for the remaining toner detection circuit illustrated in FIG. 4.

FIG. 5 is a graph showing the relationship between the aforementioned electrostatic capacity and the amount of the toner in the toner storing portion 1, in which the axis of the abscissas represents the amount of the remaining toner, and the axis of ordinates represents the electrostatic capacity. When there is toner between the two electrodes, the electrostatic capacity between the two electrodes is large, and as the amount of toner decreases, the electrostatic capacity decreases. Therefore, the change in electrostatic capacity is detected by the remaining toner detection circuit provided on the apparatus main assembly side, and when the detected electrostatic capacity drops below a predetermined value C, it is determined that the toner is absent.

It should be noted here that even when it is determined based on the output of the remaining toner detection circuit 100 that toner is absent, toner T indicated by hatching in FIG. 2 still remains in a space beyond the sweeping range of the toner feeding member 21, though the amount of toner T is very small.

Figure 6:
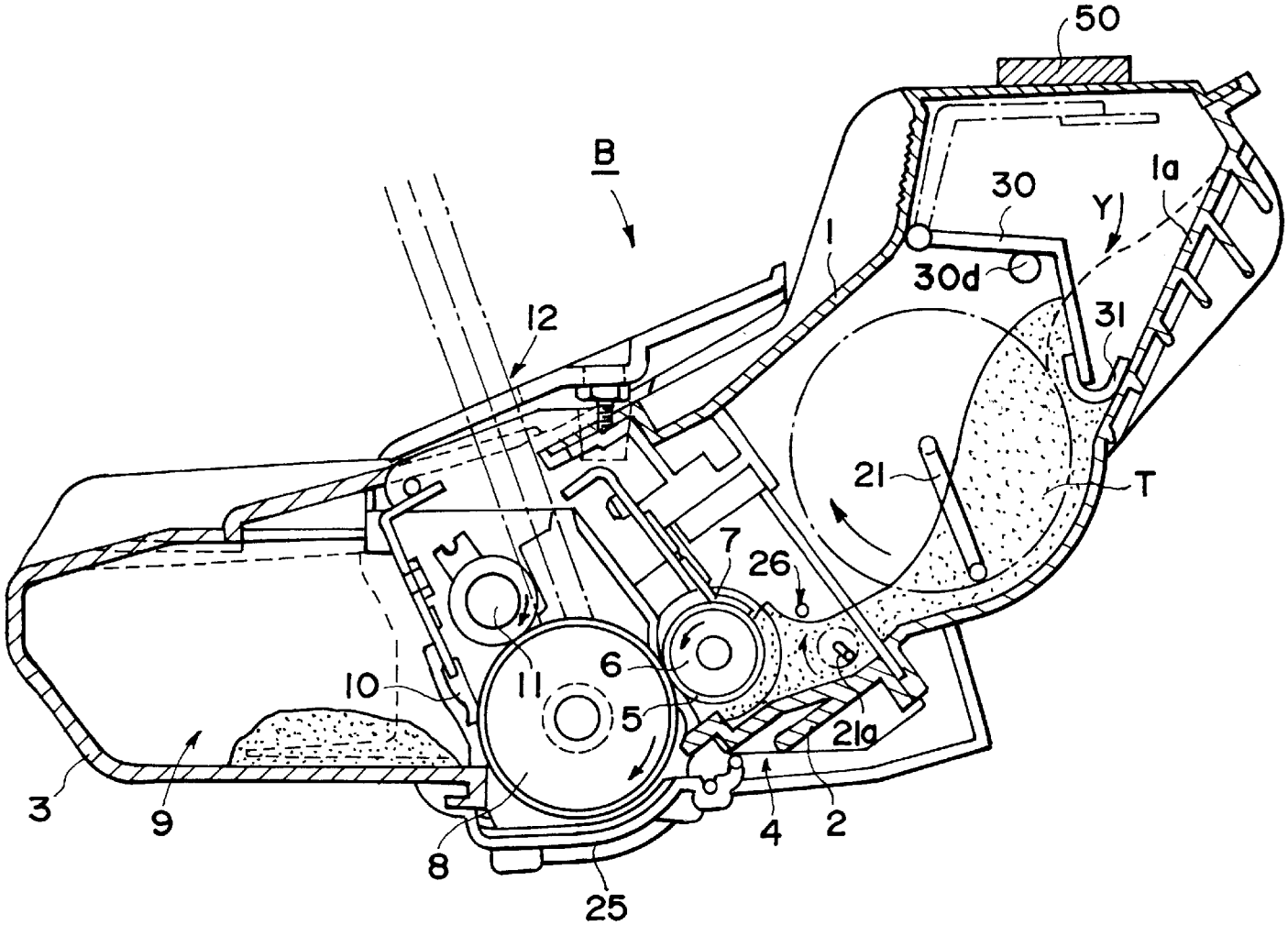
FIG. 6 is a sectional view of the process cartridge illustrated in FIG. 2, and depicts a state of the process cartridge in which the developer conveying means is in operation.
Figure 7:
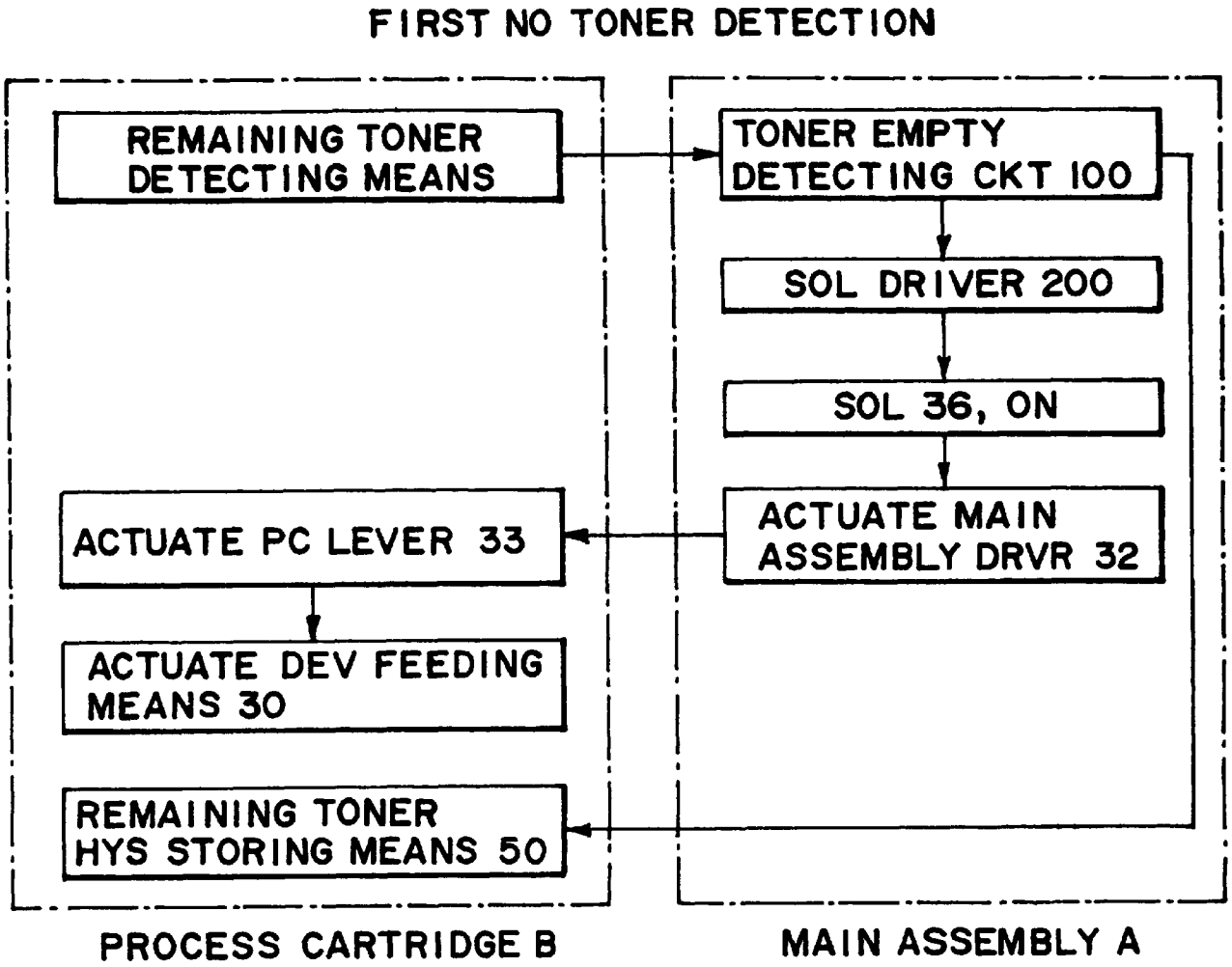
FIG. 7 is a block diagram which shows the first no-toner detection.

FIG. 7 is a block diagram for the remaining toner detection control. This diagram shows the control executed when the absence of toner is detected first time. After it is determined by remaining the toner detecting means and the remaining toner detection circuit that toner is absent, an ON signal is sent through a solenoid driver circuit 200 to the solenoid 36 on the main assembly side of the image formation apparatus A illustrated in FIG. 3, to move the lever 32. As a result, the lever 33 on the process cartridge side B is rotated, and the claw portion 33*a* is disengaged from the arm portion 30*b* of the developer conveying means 30. Consequently, the developer conveying means 30 rotates due to the pressure from the spring 35 having been wound to generate pressure to rotate the developer conveying means 30 in the direction of an arrow mark Y in FIGS. 2 and 6, and stops as it comes in contact with the stopper 30*d*. During this movement of the developer conveying means 30, its flexible member 31 conveys the remaining toner T in a manner to move it into the sweeping range of the toner feeding member 21. Then, the toner T is conveyed in the normal manner by the toner feeding member 21 toward the development station. More specifically, the remaining toner T is pushed out by the flexible member 31 along a slanted surface la sloped toward the toner feeding member 21, that is, one of the walls of the toner storing portion 1 (FIGS. 2 and 6 depict the state of the process cartridge B in the main assembly of the image formation apparatus A).

Also during the rotational movement of the developer conveying means 30, the amount of the remaining toner in the toner storing portion 1 is extremely small, and therefore, the effect of the increased rotational load upon the main assembly of the image formation apparatus remains at an extremely low level.

The detection of "toner absence" is stored, as cartridge-specific information, in a storing means 50 such as an RAM provided in the process cartridge B. This storing means 50 is capable of receiving information from the main assembly of the image formation apparatus A through an electrical contact (unillustrated) provided in the process cartridge B.

After being moved into the sweeping range of the toner feeding member 21 by the developer conveying means 30, and further conveyed by the toner feeding member 21, the toner T is supplied to the photosensitive drum 8 by the development roller 5. Thus, image formation is continued without interruption. Next, as this toner T is consumed to a point at which the substantially no toner remains within the sweeping range of the toner feeding member 21, a second remaining toner detection process is carried out.

Figure 8:
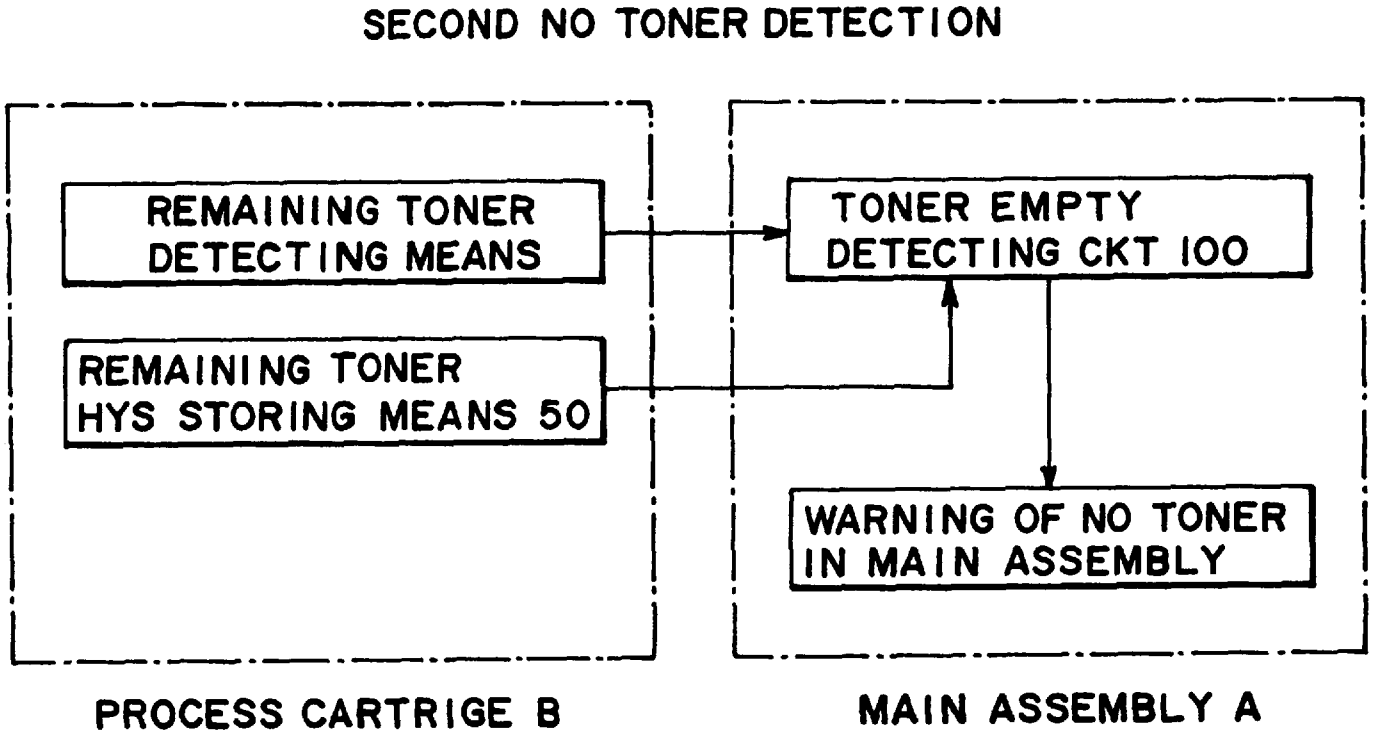
FIG. 8 is a block diagram which shows the second no-toner detection.
Figure 9:
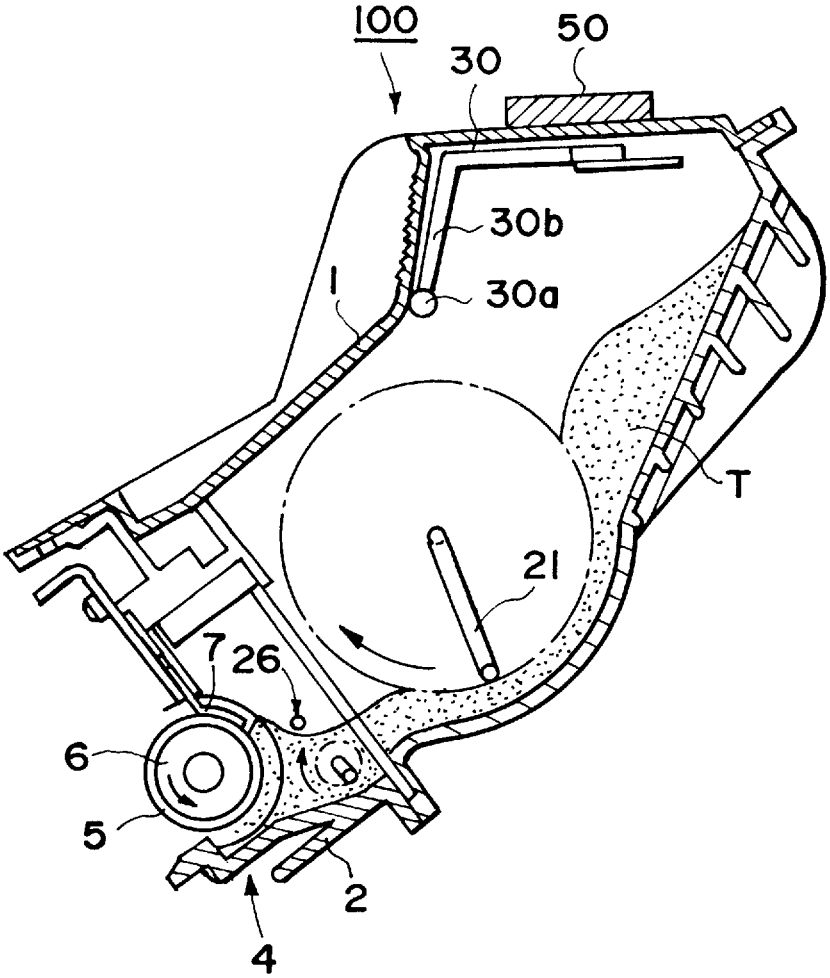
FIG. 9 is a sectional view of the development apparatus in the second embodiment of the present invention.

FIG. 8 is a block diagram for the control executed after the absence toner is detected a second time. As shown in FIG. 8, when the absence of toner is detected for the second time, this information is combined with the information stored as remaining toner detection history in the storing means 50, that is, "the absence of toner has been detected once," and a "no toner" warning message is displayed in the display section of the apparatus main assembly. Further, an arrangement may be made so that the image forming operation on the apparatus main assembly side can be temporarily prohibited if necessary.

Even when the process cartridge B is transferred to another image formation apparatus before the second remaining toner detection, the absence of toner warning can be reliably displayed by the main assembly of the second image formation apparatus A, since "toner absence has already been detected once" is recognized as cartridge specific information by the main assembly of the second image formation apparatus A.

As described above, in this embodiment, the activation of the developer conveying means is linked to the results of the remaining toner detection by the remaining toner detecting means, making it possible to reliably convey the remaining toner in the toner storing portion, to the toner feeding member. Therefore, it is possible to prevent production of an image with white spots caused by lack of toner, without increasing the capacity of the driving source on the main assembly of the image formation apparatus A.

Embodiment 2

The development apparatus 100 in this embodiment is a process cartridge constructed by integrally disposing a developer carrier member 5 like the aforementioned development roller, and a developing means 4 comprising a developer container portion containing developer (toner) to be supplied to the developer carrier member 5, in a plastic frame 2. In other words, the development apparatus 100 in this embodiment can be thought to be the process cartridge described in the first embodiment minus the photosensitive drum. Therefore, the structures and operations of the developer storing portion and the developer conveying means are the same as those described in the first embodiment. Thus, the components or sections which have the same structure or function as those in the first embodiment are designated by the same reference numerals as those in the first embodiment, and their descriptions will be omitted.

Embodiment 3

Next, referring to FIGS. 10 and 11, the third embodiment of the process cartridge in accordance with the present invention will be described.

This embodiment is different from the first embodiment only in the mechanical structure of the developer conveying means. Since other aspects such as remaining toner detection, solenoid operation on the apparatus main assembly side, and an absence of toner warning display on the main assembly side are the same as those in the first embodiment, reference to the description given in the first embodiment will suffice.

Figure 10:
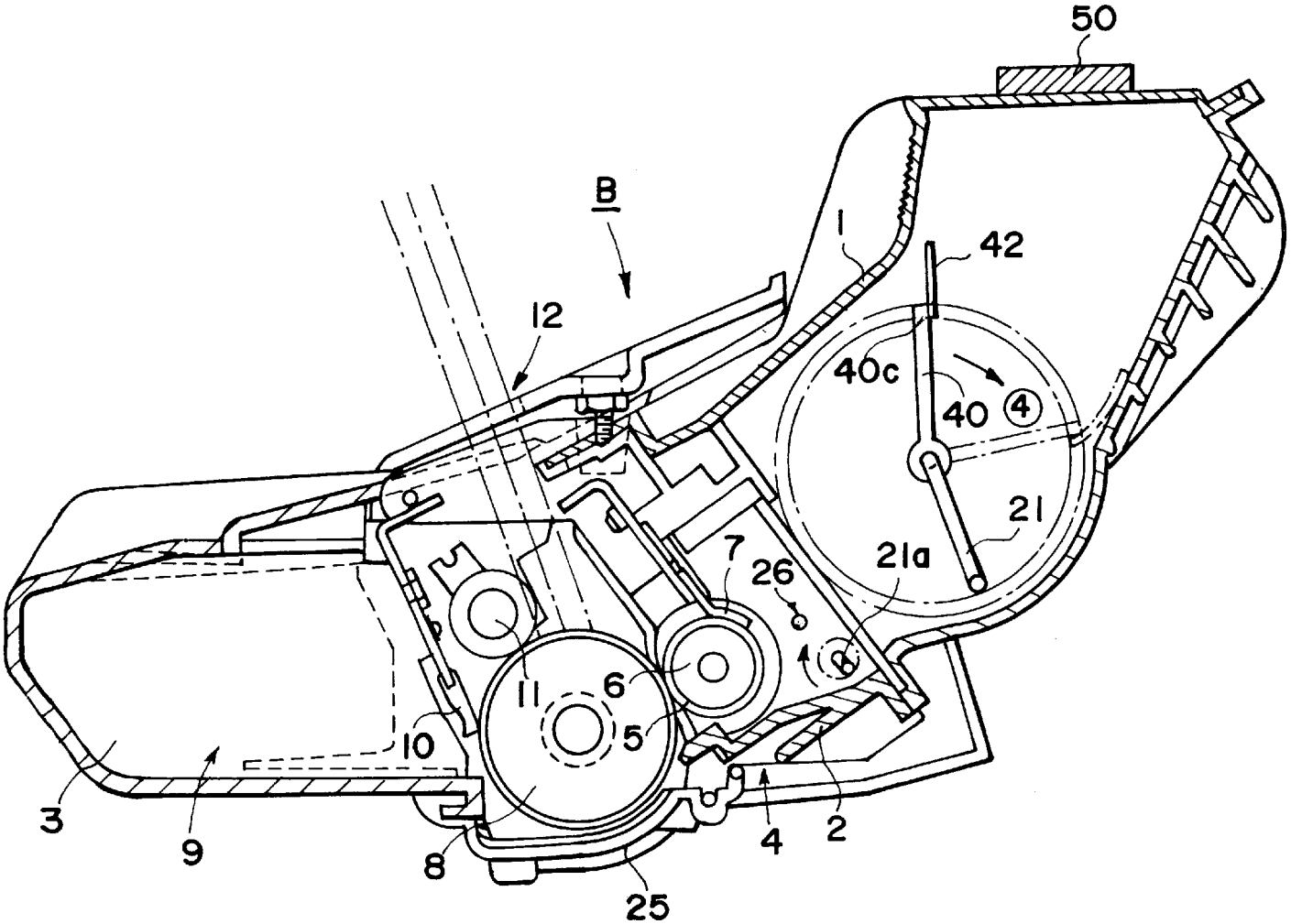
FIG. 10 is a sectional view of the process cartridge in the third embodiment of the present invention.
Figure 11:
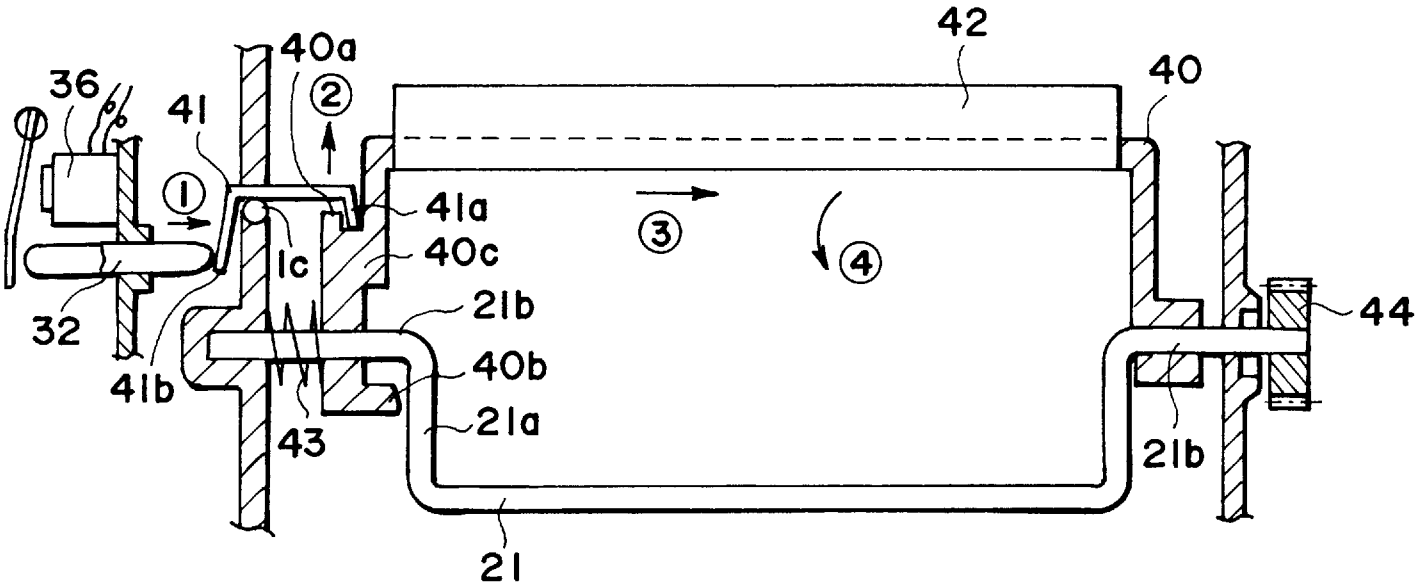
FIG. 11 is a sectional view of the developer conveying means of the process cartridge illustrated in FIG. 10.

FIGS. 10 and 11 shows the structure of the developer conveying means in this embodiment. In these drawings, only the sections different from the first embodiment will be described. The developer conveying means 40 is rotatively mounted on the same rotational axis as the toner feeding member 21, sharing the same rotational center.

The developer conveying means 40 is substantially in the form of a crank, and a flexible member 42 is attached to its portion equivalent to the horizontal portion of a crank. It is rotatively mounted coaxially with the toner feeding member 21. One of the arm portions 40*c* is provided with an engagement portion 40*a*, with which the tip of the lever 41 on the process cartridge side engages. The lever 41 is put through the wall of the toner storing portion 1. Also, the other end of the arm portion 40*c* is provided with a claw portion 40*b* which is rendered engageable with the arm portion 21*a* of the toner feeding member 21. Further, the arm portion 40*c* is kept under the pressure generated by a compression spring 43 in the direction to cause the claw portion 40*b* to come in contact with the arm portion of the toner feeding member 21. The compression spring 43 is attached to the toner storing portion 1 in a manner to wrap around the rotational axis 21*b*.

The lever 41 of the process cartridge is provided with a pressure receiving portion 41*b* with which the lever 32 of the apparatus main assembly makes contact. This pressure receiving portion 41*b* is outside the toner storing portion 1. As the pressure receiving portion 41*b* is pressed by the lever 41 of the process cartridge, it rotates about the support portion 1*c* of the toner storing 1, in the counterclockwise direction of the drawing.

To the other end of the rotational axis 21*b* of the toner feeding member 21, a helical gear 44 is fixed, through which the driving force from a driving power source is transmitted to drive the developer conveying means 40.

In the structure described above, as the solenoid 36 provided on the main assembly of the image formation apparatus A is turned on, the lever 32 on the main assembly side is moved in the direction of an arrow mark (1). As a result, the lever 41 on the process cartridge side is rotated about the support portion 1*c* in the direction of an arrow mark (2). This rotation of the lever 41 causes the claw portion 41*a* to disengage from the engagement portion 40*a* of the developer conveying means 40. Then, the entire developer conveying means 40 is thrust in the direction of an arrow mark (3) by the pressure from the compression spring 43. Consequently, the claw portion 40*b* becomes engaged with the arm portion of the toner feeding member 21, and causes the developer conveying means to rotate together with the toner feeding member 21 in the direction of an arrow mark (4). As a result, the same effect as an effect obtainable by increasing the sweeping range diameter of the toner feeding member 21 can be realized. Further, the toner closer to or adhering to the internal surface of the toner containing portion can be reliably conveyed by the flexible member 42 attached to the horizontal portion of the developer conveying means 40.

Also during this rotational movement of the developer conveying means 30, the amount of the toner remainder in the toner storing portion 1 is extremely small, and therefore, the effect of the increased rotational load upon the main assembly of the image formation apparatus A remains at an extremely low level.

In any of the first, second and third embodiments, the remaining toner detecting means was described as a means employing a system which detects absence of toner by detecting the change in electrostatic capacity, but the same effects can be obtained by employing a different system in which the toner absence is detected by detecting the change in light transmission, developer weight, or torque needed by a toner stirring member.

Further, it is obvious that the third embodiment is applicable to the second embodiment. The description of such an application will be omitted since reference to the description of the third embodiment will suffice.

As is evident from the above descriptions, according to the preceding embodiments, as the developer in the developer storing portion decreases, the developer is moved without the need for increasing the capacity of the driving power source on the apparatus main assembly side. Therefore, it is possible to provide a process cartridge and a development apparatus, which do not need to be shaken, and are capable of preventing production of an image with white spots caused by lack of toner, and also to provide an image formation apparatus compatible with such a process cartridge or development apparatus. Thus, it is possible to improve operational efficiency in image formation, and to produce a high quality image.

Further, according to the present invention, waste in toner consumption can be further reduced.

What is claimed is:

1. A process cartridge detachably mountable relative to a main assembly of an electrophotographic image forming apparatus, comprising:

an electrophotographic photosensitive member;

developing means for developing a latent image formed on said electrophotographic photosensitive member;

a toner accommodating portion for accommodating toner to be used by said developing means to develop the latent image;

a first toner feeding member for feeding the toner accommodated in said toner accommodating portion toward said developing means;

a second toner feeding member for feeding the toner accommodated in the toner accommodating portion toward said developing means;

wherein said second toner feeding member starts to operate in response to a detection signal indicative of a decrease of a remaining amount of the toner accommodated in the toner accommodating portion and cooperates with said first toner feeding member, which is already operating, to feed the toner accommodated in the toner accommodating portion toward said developing means.

2. An apparatus according to claim 1, wherein said second toner feeding member is operated by elastic force of an elastic member.

3. A process cartridge according to claim 2, wherein said elastic member includes a coil spring or compression spring.

4. A process cartridge according to claim 1 or 2, wherein the operation of said second toner feeding member is constrained by a locking member, which is releasable by a releasing member provided in the main assembly in response to the detection signal.

5. A process cartridge according to claim 4, wherein said releasing member includes a solenoid actuated in response to the detection signal.

6. A process cartridge according to claim 1 or 2, further comprising a storing element for storing detection hysteresis of the remaining amount of the toner accommodated in said toner accommodating portion.

7. A process cartridge according to claim 1 or 2, wherein the first toner feeding member is rotated in accordance with rotation of said electrophotographic photosensitive member.

8. A process cartridge according to claim 7, wherein when the process cartridge is mounted to the main assembly, said electrophotographic photosensitive member is rotated by driving force received from the main assembly, and said first toner feeding member is rotated by the driving force.

9. A process cartridge according to claim 1, further comprising a charging member for charging said electrophotographic photosensitive member.

10. A process cartridge according to claim 1 or 9, further comprising a cleaning member for removing the toner remaining on the electrophotographic photosensitive member.

11. An electrophotographic image forming apparatus for forming an image on a recording material, to which a process cartridge is detachably mountable, comprising:

a. a mounting portion for detachably mounting a process cartridge, said process cartridge including,
an electrophotographic photosensitive member;
developing means for developing a latent image formed on said electrophotographic photosensitive member;
a toner accommodating portion for accommodating toner to be used by said developing means to develop the latent image;
a first toner feeding member for feeding the toner accommodated in said toner accommodating portion toward said developing means;
a second toner feeding member for feeding the toner accommodated in the toner accommodating portion toward said developing member;
wherein said second toner feeding member starts to operate in response to a detection signal indicative of a decrease of a remaining amount of the toner accommodate in the toner accommodating portion and cooperates with said first toner feeding member, which is already operating, to feed the toner accommodated in the toner accommodating portion toward said developing means;

b. detecting means for detecting the remaining amount of toner accommodated in said toner accommodating portion of said process cartridge and outputting the detection signal; and c. driving means for operating said second toner feeding member in accordance with the detection signal.

12. An apparatus according to claim 11, wherein said second toner feeding member of said process cartridge is operated by elastic force of an elastic member.

13. An apparatus according to claim 12, wherein said elastic member includes a coil spring or compression spring.

14. An apparatus according to claim 11 or 12, wherein the operation of said second toner feeding member of said process cartridge is constrained by a locking member, which is releasable by said driving member in response to the detection signal.

15. An apparatus according to claim 14, wherein said driving member includes a solenoid actuated in response to the detection signal.

16. An apparatus according to claim 11 or 12, further comprising a storing element for storing detection hysteresis of the remaining amount of the toner accommodated in said toner accommodating portion.

17. An apparatus according to claim 11 or 12, wherein the first toner feeding member is rotated in accordance with rotation of said electrophotographic photosensitive member.

18. An apparatus according to claim 17, wherein when the process cartridge is mounted to the main assembly, said electrophotographic photosensitive member is rotated by driving force received from the main assembly, and said first toner feeding member is rotated by the driving force.

19. An apparatus according to claim 11, further comprising a charging member for charging said electrophotographic photosensitive member.

20. An apparatus according to claim 11 or 19, further comprising a cleaning member for removing the toner remaining on the electrophotographic photosensitive member.

21. A developing device, usable with an electrophotographic image forming apparatus, for developing a latent image formed on the photosensitive member, comprising:

a developing member for developing the latent image formed on the photosensitive member;
a toner accommodating portion for accommodating toner to be used by said developing member to develop the latent image;
a first toner feeding member for feeding the toner accommodated in said toner accommodating portion toward said developing member;
a second toner feeding member for feeding the toner accommodated in the toner accommodating portion toward said developing member;
wherein said second toner feeding member starts to operate in response to a detection signal indicative of a decrease of a remaining amount of the toner accommodated in the toner accommodating portion and cooperates with said first toner feeding member, which is already operating, to feed the toner accommodated in the toner accommodating portion toward said developing member.

22. An device according to claim 21, wherein said second toner feeding member is operated by elastic force of an elastic member.

23. An device according to claim 22, wherein said elastic member includes a coil spring or compression spring.

24. An device according to claim 21 or 22, wherein the operation of said second toner feeding member is constrained by a locking member, which is releasable by a releasing member provided in the main assembly in response to the detection signal.

25. An device according to claim 24, wherein said releasing member includes a solenoid actuated in response to the detection signal.

26. An device according to claim 21 or 22, further comprising a storing element for storing detection hysteresis of the remaining amount of the toner accommodated in said toner accommodating portion.

27. An device according to claim 21 or 22, wherein the first toner feeding member is rotated in accordance with rotation of said electrophotographic photosensitive member.

28. An electrophotographic image forming apparatus for forming an image on a recording material, comprising:

a. a developing device which includes:
a developing member for developing the latent image formed on the photosensitive member;
a toner accommodating portion for accommodating toner to be used by said developing member to develop the latent image;
a first toner feeding member for feeding the toner accommodated in said toner accommodating portion toward said developing member;

a second toner feeding member for feeding the toner accommodated in the toner accommodating portion toward said developing member;

wherein said second toner feeding member starts to operate in response to a detection signal indicative of a decrease of a remaining amount of the toner accommodated in the toner accommodating portion and cooperates with said first toner feeding member, which is already operating, to feed the toner accommodated in the toner accommodating portion toward said developing member.

said apparatus further comprising:

b. detecting means for detecting the remaining amount of the toner accommodated in said toner accommodating portion of said process cartridge; and c. driving means for operating said second toner feeding member in accordance with the detection signal.

29. An apparatus according to claim 28, wherein said second toner feeding member of said developing device is operated by elastic force of an elastic member.

30. An apparatus according to claim 29, wherein said elastic member includes a coil spring or compression spring.

31. An apparatus according to claim 28 or 29, wherein the operation of said second toner feeding member of said developing device is constrained by a locking member, which is releasable by a releasing member provided in the main assembly in response to the detection signal.

32. A apparatus according to claim 31, wherein said releasing member includes a solenoid actuated in response to the detection signal.

33. An apparatus according to claim 28 or 29, further comprising a storing element for storing detection hysteresis of the remaining amount of the toner accommodated in said toner accommodating portion.

34. An apparatus according to claim 28 or 29, wherein said first toner feeding member of said developing apparatus is rotated in accordance with rotation of said photosensitive member.

* * * * *

UNITED STATES PATENT AND TRADEMARK OFFICE

CERTIFICATE OF CORRECTION

PATENT NO. : 5,864,731

DATED : January 26, 1999

INVENTOR(S) : ISAO IKEMOTO, ET AL.

It is certified that error appears in the above-identified patent and that said Letters Patent is hereby corrected as shown below:

COVER PAGE [73] ASSIGNEE,
"Canon Kabushiki Kaisa" should read --Canon Kabushiki Kaisha--.

COLUMN 7,
Line 41, "first" should read --for the first--.
Line 42, "remaining the" should read --the remaining--.

COLUMN 8,
Line 6, "an" should read --a--.
Line 17, "the" (1st occurrence) should be deleted.
Line 21, "toner" should read --of toner--.

COLUMN 12,
Line 37, "An" should read --A--.
Line 40, "An" should read --A--.
Line 42, "An" should read --A--.
Line 47, "An" should read --A--.
Line 50, "An" should read --A--.
Line 54, "An" should read --A--.

UNITED STATES PATENT AND TRADEMARK OFFICE

CERTIFICATE OF CORRECTION

PATENT NO. : 5,864,731

DATED : January 26, 1999

INVENTOR(S) : ISAO IKEMOTO, ET AL.

It is certified that error appears in the above-identified patent and that said Letters Patent is hereby corrected as shown below:

COLUMN 13,
Line 11, "member." should read --member,--.

Signed and Sealed this

Eleventh Day of January, 2000

*Attest:*

*Attesting Officer*

Q. TODD DICKINSON

*Acting Commissioner of Patents and Trademarks*